United States Patent [19]

Koychev et al.

[11] 4,259,919

[45] Apr. 7, 1981

[54] APPARATUS FOR COATING GRAPHITE ELECTRODES

[75] Inventors: Todor Y. Koychev; Georgi M. Georgiev; Lyuben K. Lazov; Alexander Y. Valchev, all of Sofia, Bulgaria

[73] Assignee: DSO "Cherna Metalurgia", Sofia, Bulgaria

[21] Appl. No.: 6,758

[22] Filed: Jan. 26, 1979

[51] Int. Cl.[3] ..... B05B 13/04

[52] U.S. Cl. ..... 118/47; 82/2 R; 118/72; 118/321; 118/620; 427/113

[58] Field of Search ..... 427/113; 118/320, 321, 118/47, 620, 72, 500, DIG. 11; 82/2 R

[56] References Cited

U.S. PATENT DOCUMENTS

| | | | |
|---|---|---|---|
| 3,864,164 | 2/1975 | Hinchcliffe et al. | 427/113 |
| 3,939,028 | 2/1976 | Schiffarth et al. | 427/113 |
| 3,951,103 | 4/1976 | Hinchcliff et al. | 118/321 |
| 4,077,357 | 3/1978 | Peev et al. | 118/321 |

FOREIGN PATENT DOCUMENTS

| | | | |
|---|---|---|---|
| 1521385 | 8/1969 | Fed. Rep. of Germany | 427/113 |

*Primary Examiner*—John D. Smith
*Attorney, Agent, or Firm*—Karl F. Ross

[57] ABSTRACT

An apparatus for the automated coating of graphite electrodes comprises a carriage shiftable parallel to the coating apparatus between a station in which the graphite electrode is preheated and a station in which the preheated electrode is positioned opposite the coating station onto which the electrode is then gripped between a pair of contacts and rotated at variable speeds while all of the coating and surfaces treatment tools on a carriage flanking the electrode are brought into play successively by reciprocation of the tool carriage alongside the electrode.

4 Claims, 1 Drawing Figure

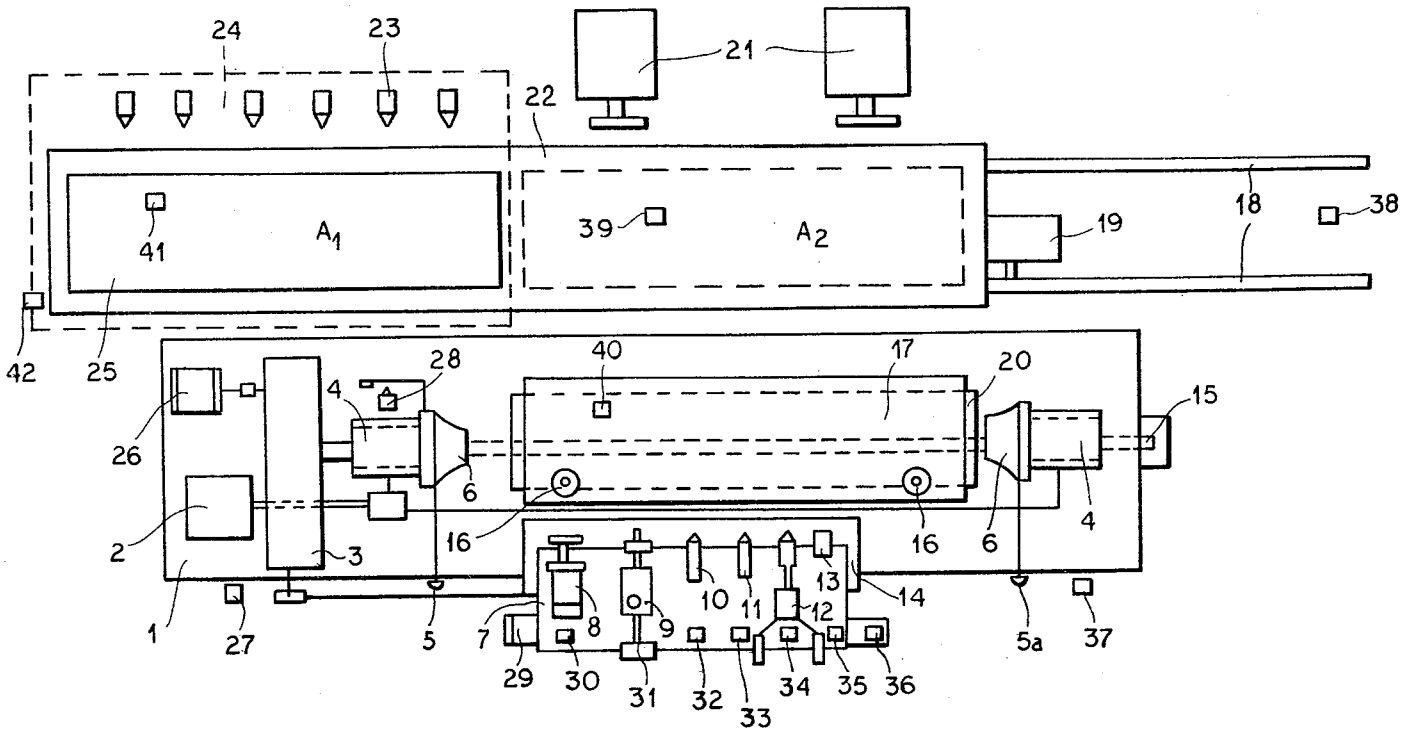
38
18
19
21
22
23
24
A2
39
A1
41
42
25
15
4
20
6
17
16
40
28
3
26
2
1
27
5
7
29
30
8
31
9
10
32
11
33
12
34
13
35
14
36
37
5a

APPARATUS FOR COATING GRAPHITE ELECTRODES

FIELD OF THE INVENTION

This invention relates to an automatic apparatus for applying a protective coating to graphite electrodes used in electric steelmaking.

BACKGROUND OF THE INVENTION

A known lathe-type device for the application of a protective coating to graphite electrodes has the electrode disposed between centers while the working tools are arranged on a slide to separate feed tables.

This apparatus has the disadvantage that full automation of the process is not possible because of the required change-over of the gearbox for the different runs. The apparatus has low productivity and the need for different feed tables for each working tool, which makes it expensive and complex. The productivity is also reduced when resetting the device is needed upon changing over from one electrode diameter to another.

It is also known to provide a processing line on which, on several different machines, connected by crane and rail conveying equipment, are performed all operations for the application of the protective coating, the electrode being conveyed from one machine to another for the performance of each operation.

This system requires massive and expensive machinery and a large building for them, has low productivity per unit weight; a large area; requires expensive labor and high installed power and is associated with a large number of auxiliary devices, which leads to a reduction of reliability.

OBJECT OF THE INVENTION

It is, therefore, a general object of the invention to avoid the aforementioned disadvantages of the known machines and devices by providing an automatic device, in which all processes are automated at a considerable increase in productivity in terms of equipment weight, area, and installed power, as well as with respect to labor consumption.

SUMMARY OF THE INVENTION

This object is achieved by a device, comprising a horizontal body built-up of standard metal sections, in one side of which there are shaped parallel guides over which there is arranged a slide, and other parallel guides on the other side of the body, over which there are disposed two carriers, connected to a drive. Between the carriers there is a support for an electrode, while over the body in the opposite ends of both carriers there are seated coaxially two contact clamps, one of which is connected to a reduction gear, driven by an electric motor with stabilized variable speed, and both are connected to a device moving them one against the other. Over the slide, which is provided with an individual drive, driven by an electric motor, there is fastened movably a table, common for all working tools for the application of the protective coating, and the motor is connected to the reducing gear, driven by the electric motor with stabilized regulatable speed, while each contact clamp is connected to a deflector, and when an electrode is clamped between the contact clamps the distance between both deflectors is always equal to the length of the electrode. Behind the body of the device there is an attending carriage for several electrodes, connected with a travel device, one half of which is in the area of heating-up the electrode, while its other half lies in the area opposite the region of the contact clamps. In the region of the contact clamps, behind the carriage, there is an electrode loading device, while underneath them and in front of their axis there is an electrode pushing device.

The advantages of the device of the present invention are: the total automation of the working process; a greater productivity in terms of labor and power as compared with the existing devices; simpler equipment is needed for constructing the automatic device, which reduces the costs for metals and labor; an easy processing of the electrodes is provided, without the need of attaching to them additional jigs; better ergonomic working conditions are provided.

BRIEF DESCRIPTION OF THE DRAWING

For a better understanding of the invention, reference should be made to the accompanying drawing, in which the sole FIGURE shows in plan view an automatic device, according to the invention, disposed in an isolating cabin.

SPECIFIC DESCRIPTION

To body 1 there are fastened movably one with respect to the other the carriers 4 with contact clamps 6. Between these carriers, over the body, lies the adjustable support 20. The contact clamps 6 are connected to deflectors 5, one of them being connected to the reduction gear 3, coupled to an electric motor 26 with stabilized controlled speed. Both carriers 4 have a drive 15, while the contact clamps 6 are provided with a driving device 2. In front of and underneath the axis of the contact clamps 6 is an electrode pushing device 16, and in front of their axis also a slide 14, connected movably to the body 1, connected to the reduction gear 3 and provided with an individual drive by electric motor 29. Above the slide there is mounted a movable table 7, onto which there are attached and fastened all working tools in the following order: roughening tool 13, electric metal spray gun 12, device for the application of a coat of alloying substances 11, device for the application of a graphite coating 10, head for electric arc processing 9, and grinder 8. Behind the body 1 there is an attending carriage for several electrodes 22, provided with a travelling device 19 and rails 18. Its one half $A_1$ is disposed in the area of heating-up the electrode 24, where there are the heating-up elements 23, while its other half is in front of the electrode loading device 21, which is in the region between both contact clamps 6.

The device operates by an electric circuit of known type, its operation being as follows: the actuated contact clamps 6 release the electrode 17, which is pulled by the driving device 2, in position over the support 20. Then the elecrode pushing device 16 is actuated, which by moving upwards, rolls-over the electrode 17 over the free area of the attending carriage 22.

Ba pressing-down a start button, the empty attending carriage 22 is moved in direction $A_1A_2$ until its travel is interrupted by sensor 38. Over its area $A_1$ there is positioned the electrode which is to be coated. It presses sensor 41, which after a certain delay, switches-on the travel device 19, so that it performs the motion of the attending carriage 22 in direction $A_2A_1$, until it touches the sensor 42, which stops its motion in direction $A_2A_1$ and switches-on the heating-up of the electrode by gas flame from nozzles 23. After a determined time, sufficient for the heating-up of the electrode, it is interrupted and by pressing down a button the travel device 19 is again actuated and pulls the carriage in direction $A_1A_2$, until it reaches sensor 38, thus starting the cyclic automatic operation of the device.

Sensor 38 releases a command for the return in initial position of the electrode pushing device 16, and after its return, for actuation of the electrode loading device 21, it pushes the heated-up electrode 25 over the adjustable support 20 in the range of the contact clamps 6, and the electrode actuates by its weight the sensor 40, which releases a command for return in initial position of the electrode loading device 21 and for clamping by the contact clamps 6 of the heated-up electrode which is in the automatic device. When moving one against the other, the contact clamps 6 lift and clamp the electrode, thus actuating sensor 28. It indicates, that with respect to carriers 4, the contact clamps 6 are not in fully loosened or tightened position under the action of device 2, which actuates them by compressed air. Sensor 28 releases immediately a command and slide 14 travels from initial position fastly forward, thus starting the working process of application of the electrode coating.

During the operation of the automatic device, the operator places over area $A_1$ of the attending carriage 22 a new electrode and removes from area $A_2$ the ready one. By touching the sensor 41 and releasing the sensor 39, the travel device 19 is actuated with a certain delay and pulls the attending carriage 22 in direction $A_2A_1$ until touching and actuating sensor 42, which stops its motion in direction $A_2A_1$, at an introduced in the heating-up area 24 new electrode 25. In this position, the free area $A_2$ of the attending carriage 22 is in position opposite to the processed electrode 17 and is ready to take it up after the application of the protective coating.

At the start of the working process, slide 14 moves first the working tools at fast travel, until reaching the sensor 36 and the deflector 5, determining exactly the position of beginning of the processed electrode. Sensor 36 switches-off the fast travel and switches-on the first working forward run, and at that there is actuated the relay supplying in cyclic work the circuits of the tools, operating during the the first working forward run, i.e.: the roughening tool 13, the electric metal spray gun 12, the device for applying a coat of alloying substances 11 and the head for electric-arc treatment 9. During the travel of slide 14 there are switched-on in sequence by their sensors and the deflector 5 at the beginning of the electrode, the roughening tool 13 by its sensor 35, the electric metal spraying gun 12 by its sensor 34, the device for applying a coat of alloying substances 11 by its sensor 33, and the head for electric-arc treatment 9 by its sensor 31.

Sensors 35,34,33 and 31, reaching the deflector 5A, determining exactly the end of the electrode, switch-off in sequence the tools controlled by them: sensor 31 switches-off the slow forward travel, thus stopping the first working forward run, switches-on a relay and switches-on the first fast backward run of the slide 14, effected by its drive 29. The first fast backward run is stopped when sensor 34 reaches the deflector 5, determining the beginning of the electrode. When stopping the first fast backward run, sensor 34 switches-on the second working forward run and actuates a relay, which supplies only the following tools: the electric metal spray gun 12, controlled by its sensor 34, the device for applying a coat of alloying substances 11, controlled by its sensor 33, and the head for electric-arc treatment 9, controlled by its sensor 31. When sensor 31 of the head for electric-arc treatment 9 reaches the deflector 5A, determining the end of the electrode, the second working forward run is stopped, the relay is actuated and the second fast backward run is switched-on, which continues until sensor 34 reaches the deflector 5, determining the beginning of the treated electrode. Then the second fast backward run is stopped and sensor 35 switches-on the third and last working forward run and actuates the relay supplying only the following tools: the electric metal spraying gun 12, controlled by its sensor 34, the device for applying the graphite coat 10, controlled by its sensor 32, the head for the electric-arc treatment 9, controlled by its sensor 31, and the grinder 8, controlled by its sensor 30. When sensor 30 reaches the deflector 5A, determining exactly the end of the electrode, the third working forward run is stopped, the relay is actuated and the third fast backward run is switched on, which is stopped by sensor 27 when slide 14 reaches the initial position. Sensor 30 returns the relays in inital state, after the relay has previously released a signal for actuating the contact clamps 6, which released the electrode 17, pulled-back by the driving device 2, and the electrode comes over the adjustable support 20, and then the electrode pushing device 16 is actuated which, moving upwards, rolls over the electrode 17 onto the free area of the attending carriage 22. There the electrode 17, due to its weight, excerts a pressure on sensor 39, which actuates the travelling device 19, and the attending carriage 22 starts to move in direction $A_1A_2$. Its motion is stopped when sensor 38 is reached. Then the sensor 38 releases a command for return in initial position of the electrode pushing device 16, and after its return - for the actuation of the electrode loading device 21, which pushes the heated-up electrode 25 onto the adjustable support 20. In the area of the contact clamps 6, the electrode switches-on by its weight the sensor 40, which releases a command for return in initial position of the electrode loading device 21 and for clamping by the contact clamps 6 of the heated-up electrode on the adjustable support 20. Thus ends one cycle of automatic work of the device and a new cycle, as described above, is started.

The relays provide for the necessary revolutions of motor 26 and the automatic setting of the productivity of the metal spraying gun 12 for the different working runs, the automatic setting of the current magnitude for electric-arc treatment in the different runs and the return of the head for electric-arc treatment to end backward position during the last working run, after reaching of its sensor 31 the deflector 5A, determining the end of the electrode. The relays act as machine memory.

During the working process, it is possible for the operator to stop the work of the automatic device, to perform manual operation by means of a switch, which by switching-on for manual operation, provides the supply of the working tools and their sensors by manually controlled switches. At that, the relays "memorize" the run in sequence attained by the process in the sutomatic device, and, when turning the switch in initial position, the process continues further.

The electric metal spraying gun 12, the device for applying a coat of alloying substances 11 and the device for applying the graphite coat 9 are provided with relays, actuated by variation of the preset working parameters. These relays interrupt the operative circuit, supplying all actuating mechanisms of the automatic device and signal by indicating lamps in which actuating mechanism a change has taken place.

The operative circuit is interrupted also by relay, actuating after a determined time, if the doors or the cover of the isolating cabin have been left open. This permits personnel to enter or leave the cabin during the working process, without influencing the operation of the device, and protects the attending personnel from light and noise.

The interruption of the operative circuit and the indication for this is effected by a relay, too, which actuates in the case of pressure drops in the air and cooling water for the machine. In actuating, the relays supply also the indicating lamps, which determine which is the sequential run of the automatic device. The relays controlling the roughening tool 13, the electric metal spray gun 12, the deive for applying the coat of alloying substances 11, the device for applying the graphite coat 10, the head for electric-arc treatment 9 and the grinder 8, when actuated supply also the indicating lamps, which indicate that the respective tool is switched-on or -off.

In automatic operation, it is possible by means of a switch to effect the interruption of the operative supply of the device for applying the graphite coat 10 and of the head for electric-arc treatment 9 in the third working forward run, which by the automatic device applies a protective coating on electrodes with a diameter smaller than 350 mm.

In resetting the automatic device for treatment of electrodes of other diameters, by means of the common 7 all working tools are disposed simultaneously and the height of the adjustable support 20, onto which the electrode 17 is placed before being clamped for treatment, is changed.

What we claim is:

1. An apparatus for the coating of graphite electrodes, comprising:

a coating station provided with a pair of axially spaced clamps adapted to receive an electrode between them and engageable with opposite ends of said electrode for rotating same about an axis, a support disposed between said clamps for holding an electrode prior to engagement of said clamps therewith and upon release of an electrode by said clamps, drive means connected to at least one of said clamps for rotating same and an electrode engaged by said clamps, a pair of deflectors each projecting from one of said clamps and having a distance between them equal in length to the length of an electrode engaged between said clamps, a tool carriage provided with a row of tools for treating the surface of an electrode retained between said clamps and shiftable parallel to said axis between limits determined by said deflectors;

a track extending alongside said coating station opposite said tool carriage and of a length at least equal to twice the length of an electrode to be treated;

an electrode carriage shiftable on said track and of a length at least twice that of an electrode to be treated whereby, half the length of the electrode carriage is disposed opposite said support, the remaining half of the electrode carriage is disposed at a location laterally offset from said support;

elecrode heating means at said location for heating at least the surface of an electode preparatory to its coating; and means for transferring an electrode from said electrode carriage to said support and from said support to said electrode carriage.

2. The apparatus defined in claim 1 wherein said tools include in order along said tool carriage: a tool for roughening the surfaces of an electrode recieved between said claimps, a spray gun for applying a metal to an electrode received between said claimps, a device for applying a coating of alloying substances to the latter electrode, a device for applying a graphite coating to an electrode between said clamps, means for treating an electrode between said clamps with an electric arc, and a grinder for grinding the surface of an electrode between said clamps.

3. The apparatus defined in claim 2, further comprising another drive means connected to said tool carriage for displacing same, each of said drive means being independently controllable and having respective speed-reducing gears.

4. The apparatus defined in claim 2 wherein said drive means is operatively connected to said tool carriage for displacing same.

* * * * *